US005365903A

United States Patent [19]

Watanabe

[11] Patent Number: 5,365,903

[45] Date of Patent: Nov. 22, 1994

[54] ENGINE IDLING SPEED CONTROL APPARATUS

[75] Inventor: Satoru Watanabe, Atsugi, Japan

[73] Assignee: Unisia Jecs Corporation, Atsugi, Japan

[21] Appl. No.: 109,537

[22] Filed: Aug. 20, 1993

[51] Int. Cl.[5] ..... F02D 41/08

[52] U.S. Cl. ..... 123/339

[58] Field of Search ..... 123/339, 352

[56] References Cited

U.S. PATENT DOCUMENTS 5,069,181 12/1991 Togai et al. ..... 123/339 X
5,249,558 10/1993 Imamura ..... 123/339
5,269,272 12/1993 Nakaniwa ..... 123/339

FOREIGN PATENT DOCUMENTS 1-179148 12/1989 Japan .

*Primary Examiner*—Tony M. Argenbright
*Attorney, Agent, or Firm*—Foley & Lardner

[57] ABSTRACT

An apparatus for controlling the engine idling speed to a target value. The apparatus is arranged to calculate a target engine idling speed value according to engine operating conditions and a model engine speed based upon the calculated target engine idling speed value. The calculated target model engine speed is used to calculate a model engine output torque required to cause the actual engine speed to follow the calculated model engine speed. A difference of the sensed engine speed from the calculated model engine speed is calculated to correct the model engine output torque. The corrected model engine output torque is used, along with the calculated model engine speed, to calculate the amount of air flow through the auxiliary air passage.

2 Claims, 4 Drawing Sheets

ENGINE IDLING SPEED CONTROL APPARATUS

BACKGROUND OF THE INVENTION

This invention relates to an engine idling speed control apparatus for controlling the amount of air permitted to enter the engine so as to maintain the engine speed at a target value when the engine is idling.

For example, Japanese Utility Model Kokai No. 1-179148 discloses an engine idling speed control apparatus which includes an auxiliary air control valve provided in an auxiliary air passage bypassing a throttle valve situated within an engine induction passage. The engine idling speed control apparatus is arranged to change the duty factor of an electrical pulse signal applied to operate the auxiliary air control valve when the engine is idling. The duty factor change is made in a manner to provide a feedback control correcting the air flow through the auxiliary air passage to maintain the engine idling speed at a target value. The duty factor $ISC_{ON}$ is calculated as $OSC_{ON}=ISC_{TW}+ISC_{CL}$ where $ISC_{TW}$ is a basic control factor calculated as a function of engine coolant temperature TW and $ISC_{CL}$ is a feedback correction factor containing integral plus proportional terms generated in response to the sensed deviation of the actual engine speed $N_e$ from the target value $N_{SET}$. For example, when an external load is produced to decrease the actual engine speed $N_e$, it is required to increase the duty factor $ISC_{ON}$ so as to zero the deviation of the actual engine speed $N_e$ from the target engine idling speed value $N_{SET}$. Since the conventional engine idling speed control apparatus is arranged to increase the duty factor gradually while monitoring the engine speed change, however, it requires much time to zero the deviation and has a slow response.

SUMMARY OF THE INVENTION

It is a main object of the invention to provide an improved engine idling speed control apparatus which has a fast response to an external load change and also to a target engine idling speed change.

There is provided, in accordance with the invention, an apparatus for controlling the idling speed of an internal combustion engine including a throttle valve provided in an induction passage for controlling the amount of air flow through the induction passage, and an auxiliary air control valve provided in an auxiliary air passage bypassing the throttle valve for controlling the amount of air flow through the auxiliary air passage. The apparatus comprises sensor means sensitive to engine speed for producing an electrical signal indicative of a sensed engine speed, means for calculating a target value for engine idling speed as a function of engine temperature, means for calculating a model engine speed based upon the calculated target engine idling speed value, means for calculating a model engine output torque based upon the calculated model engine speed, the model engine output torque being required to cause the sensed engine speed to follow the calculated model engine speed, means for calculating a model correction torque based upon a difference of the sensed engine speed from the calculated model engine speed, the model correction torque being required to correct an error in the model engine output torque, means for correcting the model engine output torque based upon the calculated model correction torque, means for calculating an amount of air flow through the auxiliary air passage based upon the corrected engine output torque and the calculated model engine speed, and means for controlling the auxiliary air control valve to permit the calculated amount of air to flow through the auxiliary air passage.

BRIEF DESCRIPTION OF THE DRAWINGS

This invention will be described in greater detail by reference to the following description taken in connection with the accompanying drawings, in which.

DETAILED DESCRIPTION OF THE INVENTION

Figure 1:
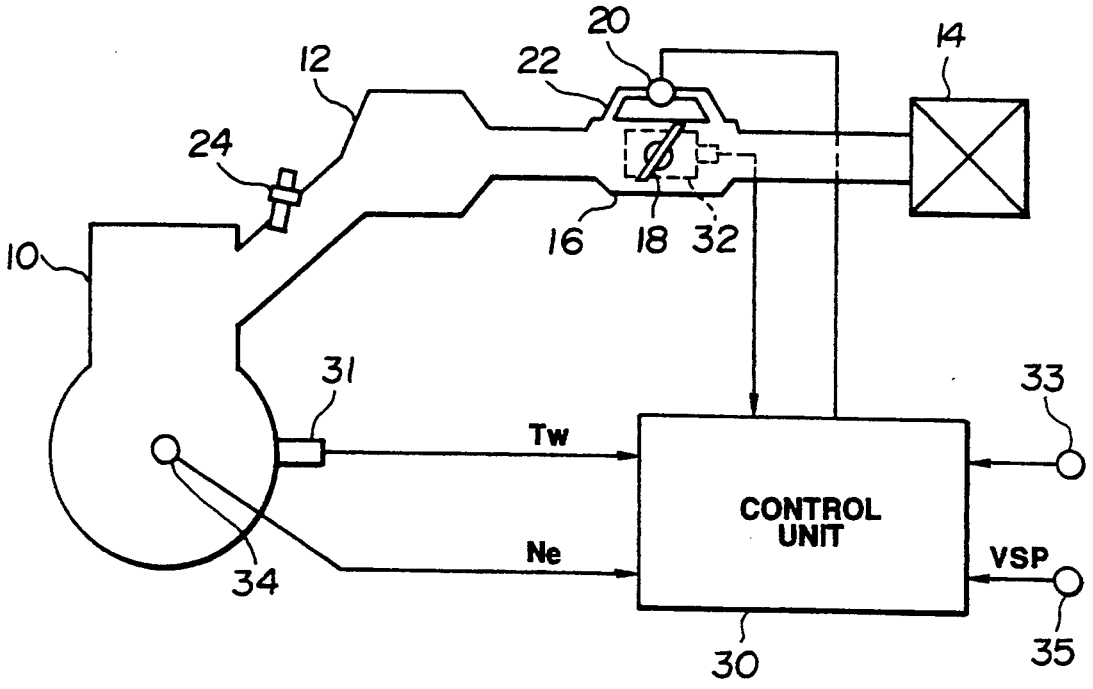
FIG. 1 is a schematic diagram showing one embodiment of an engine idling speed control apparatus made in accordance with the invention.

With reference to the drawings and in particular to FIG. 1, there is shown a schema tic diagram of an engine idling speed control apparatus embodying the invention. An internal combustion engine, generally designated by the numeral 10, for an automotive vehicle includes combustion chambers or cylinders connected to an intake manifold 12.

Air to the engine 10 is supplied through an air cleaner 14 into an induction passage 16. The amount of air permitted to enter the combustion chambers through the intake manifold 12 is controlled by a butterfly throttle valve 18 situated within the induction passage 16. The throttle valve 18 is connected by a mechanical linkage to an accelerator pedal (not shown). The degree to which the accelerator pedal is depressed controls the degree of rotation of the throttle valve 18. An auxiliary air control valve 20 is provided in an auxiliary air passage 22 bypassing the throttle valve 18 to control the amount of air introduced into the intake manifold 12 at idling conditions where the throttle valve 18 is at its closed position. The auxiliary air control valve 20 opens to permit air flow through the auxiliary air passage 22 when it is energized by the presence of an electrical pulse signal. The duty factor of the electrical pulse, that is, the ratio of the pulse-width to the repetitive period, applied to the auxiliary air control valve 20 determines the length of time the auxiliary air control valve 20 opens during the repetitive period and, thus, determines the amount of air flow in to the in take manifold 12. A fuel injector 24 is positioned to inject a controlled amount of fuel into the intake manifold 12. In the operation of the engine 10, fuel is injected intermittently in synchronism with rotation of the engine 10 through the fuel injector 24 into the intake manifold 12 and mixed with the air therein.

The amount of air metered through the auxiliary air passage 22 into the intake manifold 12, this being determined by the duty factor $ISC_{ON}$ of the electrical pulse signal applied to the auxiliary air control valve 20, is repetitively determined from calculations performed in a control unit 30. These calculations are made based upon various conditions of the engine 10 that are sensed during its operation. These sensed conditions include engine coolant temperature Tw, throttle valve position, transmission gear position, engine speed $N_e$ and vehicle speed VSP. Thus, an engine coolant temperature sensor 31, an idle switch 32, a neutral switch 33, a reference pulse generator 34 and a vehicle speed sensor 35 are connected to the control unit 30.

The engine coolant temperature sensor 31 preferably is mounted in the engine cooling system and comprises a thermistor connected in an electrical circuit capable of producing a DC voltage having a variable level proportional to engine coolant temperature. The idle switch 32 is responsive to the idling (or closed) position of the throttle valve 18 for closing to supply current from the car battery to the control unit 30. The neutral switch 33 is responsive to the position of the transmission gear in neutral for closing to supply current from the car battery to the control unit 30. The reference pulse generator 34 is associated with the engine crankshaft for producing a series of reference electrical pulses REF, each corresponding to a predetermined number of degrees (for example, 360 ° in the case of a 4-cycle engine) of rotation of the engine crankshaft, of a repetition period $T_{REF}$ inversely proportional to engine speed. The reference electrical pulses REF are converted in to a corresponding signal indicative of engine speed $N_e$. The vehicle speed sensor 35 produces an electrical signal corresponding to the speed VSP of running of the automotive vehicle.

The control unit 30 may employ a digital computer which includes a central processing unit (CPU), a random access memory (RAM), a read only memory (ROM), and an input/output control circuit (I/O). The central processing unit communicates with the rest of the computer via data bus. The input/output control circuit includes an analog-to-digital converter which converts the analog signals received from the various sensors in to digital form for application to the central processing unit. The read only memory contains the program for operating the central processing unit and further contains appropriate data in look-up table used in calculating an appropriate value for the duty factor of the electrical pulse signal applied to the idling control valve 20. The look-up data may be obtained experimentally or derived empirically. The central processing unit may be programmed in a known manner to interpolate between the data at different entry points if desired.

Figure 2:
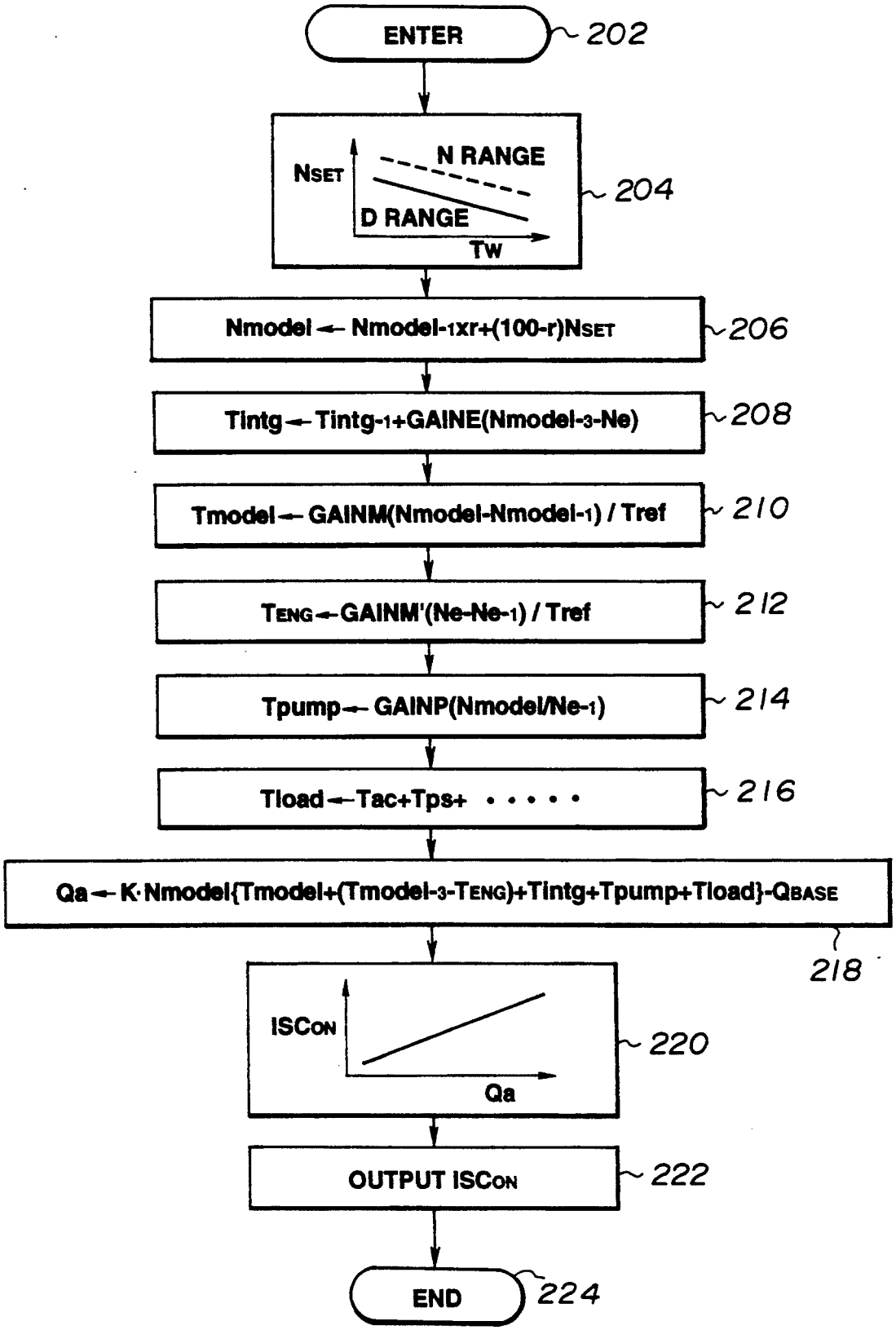
FIG. 2 is a flow diagram showing the programming of the digital computer used to operate the auxiliary air control valve.
Figure 3:
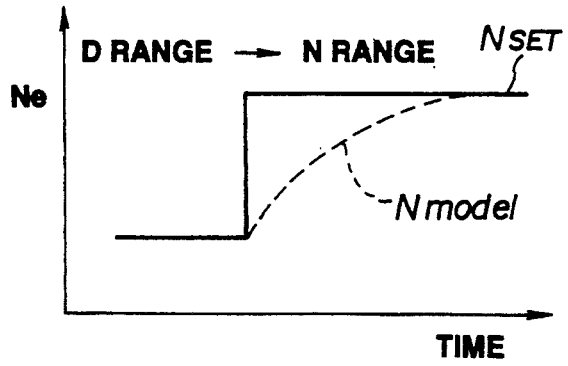
FIG. 3 is a graph used in explaining a predetermined delay of the model engine speed with respect to the target engine idling speed.

FIG. 2 is an overall flow diagram illustrating the programming of the digital computer as it is used to control the engine idling speed. The computer program is entered at the point 202 in response to a reference electrical pulse REF produced from the reference pulse generator 34 only when an idling speed control condition is fulfilled, that is, when the idle switch 32 is closed (ON) and the neutral switch 33 is closed (ON), or when the idle switch 32 is closed (ON) and the vehicle speed VSP is less than a predetermined value (for example, 8 km/h). At the point 204 in the program, the central processing unit calculates a target value $N_{SET}$ for the engine idling speed. For this purpose, the central processing unit looks at the target engine idling speed value $N_{SET}$ in a look-up table which defines the target value $N_{SET}$ as a function of engine coolant temperature Tw for a specified gear position of the automatic transmission of the vehicle, as shown in the block 204 of FIG. 2. At the point 206 in the program, a new value $N_{model}$ (its initial value is zero) for model engine speed is calculated as $$N_{model}=N_{model-1}\times r+(100-r)\times N_{SET}$$

where $N_{model-1}$ is the last model engine speed value calculated at the point 206 in the last cycle of execution of this program. That is, the new model engine speed value $N_{model}$ is the weighted average of the last model engine speed value $N_{model-1}$ and the target engine idling speed value $N_{SET}$. As shown in FIG. 3, the model engine speed $N_{model}$ is delayed a predetermined time with respect to the target engine idling speed $N_{SET}$, the predetermined time being determined by the weight r. The weight r is set according to the response time of the auxiliary air control valve 20. For example, the weight r is set at a greater value when the auxiliary air control valve 20 is of the type employing a step motor than when it is of the type employing a linear solenoid.

At the point 208 in the program, a new value $T_{intg}$ (its initial value is zero) for model correction torque required to correct an error in the model output torque $T_{model}$ which is set to obtain the model engine speed value $N_{model}$. This calculation is made as $$T_{intg}=T_{intg-1}+GAINE\cdot(N_{model-3}N_e)$$

where $T_{intg-1}$ is the last value of the model correction torque calculated at the point 208 in the last cycle of execution of this program, GAINE is a conversion constant, $N_{model-3}$ is the old model engine speed value calculated three cycles before the calculation of the new model engine speed value $N_{model}$ and $N_e$ is the actual engine speed resulting from the control of the amount of air flow through the auxiliary air passage 22 in a manner to follow the model engine speed $N_{model}$. When a difference occurs between the model engine speed $N_{model}$ and the actual engine speed $N_e$, the output engine torque required to cancel the difference is calculated as $GAINE\cdot(N_{model}-N_e)$. The central processing unit calculates the new model correction torque $T_{intg}$ by adding the calculated output engine torque $GAINE\cdot(N_{model}-N_e)$ to the last value of the model correction torque $T_{intg-1}$. When the actual engine speed $N_e$ cannot follow the model engine speed $N_{model}$ with high accuracy because of an error introduced into the model output torque $T_{model}$ calculated in a manner to cause the actual engine speed $N_e$ to follow the model engine speed $N_{model}$, as described later, the model correction torque $T_{intg}$ is used to correct the error which may be caused by engine variations, change with time or the like. In this case, the old model engine speed value $N_{model-3}$ is used. The reason for this is that the actual engine speed $N_e$ changes after a delay of ½ cycle (360° of rotation of the engine crankshaft) for a 4-cycle engine and it is possible after 360° of rotation of the engine crankshaft to judge whether or not the actual engine speed $N_e$ can follow the new model engine speed $N_{model}$. It is preferable to hold the model correction torque $T_{intg}$ after the ignition switch is turned off.

At the point 210 in the program, the central processing unit uses a conversion constant GAINM to calculate a model output torque $T_{model}$ required to cause the actual engine speed $N_e$ to follow the change in the model engine speed $N_{model}$ as $$T_{model}=GAINM\cdot(N_{model}-N_{model-1})/T_{REF}$$

That is, the actual output torque may be changed according to the model output torque $T_{model}$ in order to change the actual engine speed $N_e$ according to the change of the model engine speed $N_{model}$. The division of the repetition period $T_{REF}$ of the reference pulse signal REF is required when the model engine speed $N_{model}$ is updated for each reference pulse REF.

At the point 212 in the program, the central processing unit uses a conversion constant GAINM' to calculate the actual engine output torque change $T_{ENG}$ as $$T_{ENG}=GAINM'\cdot(N_e-N_{e-1})/T_{REF}$$

In this embodiment, an engine speed changing rate per unit time is obtained since the actual engine speed change is divided by the repetition period $T_{REF}$ of the reference electrical pulses REF produced from the reference pulse generator 34.

At the point 214 in the program, the central processing unit uses a conversion constant GAINP to calculate a non-load output torque $T_{pump}$ required to return the engine speed to the actual engine speed $N_e$ when a difference occurs when the model engine speed $N_{model}$ and the actual engine speed $N_e$ under no load condition as $$T_{pump}=GAINP\cdot(N_{model}/N_e-1)$$

At the point 216 in the program, the central processing unit utilizes the information fed from the various switches to calculate the accessary load torque $T_{LOAD}$ required for the load of the accessories such as an air conditioner, a power steering unit and the like as $$T_{LOAD}=T_{ac}+T_{ps}+\ldots$$

where $T_{ac}$ is the output torque required when the air conditioner is operating and $T_{ps}$ is the output torque required when the power steering unit is operating.

At the point 218 in the program, the central processing unit calculates a required auxiliary air amount $Q_a$, that is, the amount $Q_a$ of air to be introduced through the auxiliary air passage 22 to the engine in order to cause the actual engine speed $N_e$ to follow the model rotation speed $N_{model}$ as $$Q_a=K\cdot N_{model}\cdot\{T_{model}+(T_{model-3}-T_{ENG})+T_{intg}+T_{pump}+T_{LOAD}\}-Q_{BASE}$$

where K is a constant corresponding to a charging efficiency change and selected according to engine coolant temperature Tw, and $Q_{BASE}$ is the amount of air leaked around the throttle valve 18 during engine idling operation. The difference $(T_{model-3}-T_{ENG})$ is added to eliminate an error introduced due to engine variations. $T_{model-3}$ is the old model output torque value calculated three cycles before the calculation of the new model output torque value $T_{model}$. In this case, the old model output torque value $T_{model-3}$ is used. The reason for this is that the engine output torque changes ½ cycle (360° of rotation of the engine crankshaft) for a 4-cycle engine after the auxiliary air control valve 20 is controlled to change the auxiliary air amount $Q_a$ and it is possible after 360° of rotation of the engine crankshaft to judge whether or not the new model output torque $T_{model}$ is satisfied.

At the point 220 in the program, the central processing unit looks at the duty factor $ISC_{ON}$ of the electrical pulse signal applied to the auxiliary air control valve 20 in a look-up table which defines the duty factor $ISC_{ON}$ as a function of required auxiliary air amount $Q_a$. At the point 222 in the program, the calculated duty factor $ISC_{ON}$ is transferred by the central processing unit to the input/output control circuit which thereby produces an electrical pulse signal to operate the auxiliary air control valve 20 with a duty factor corresponding to the value $ISC_{ON}$ calculated by the computer. Following this, the program proceeds to the end point 224.

Figure 4:
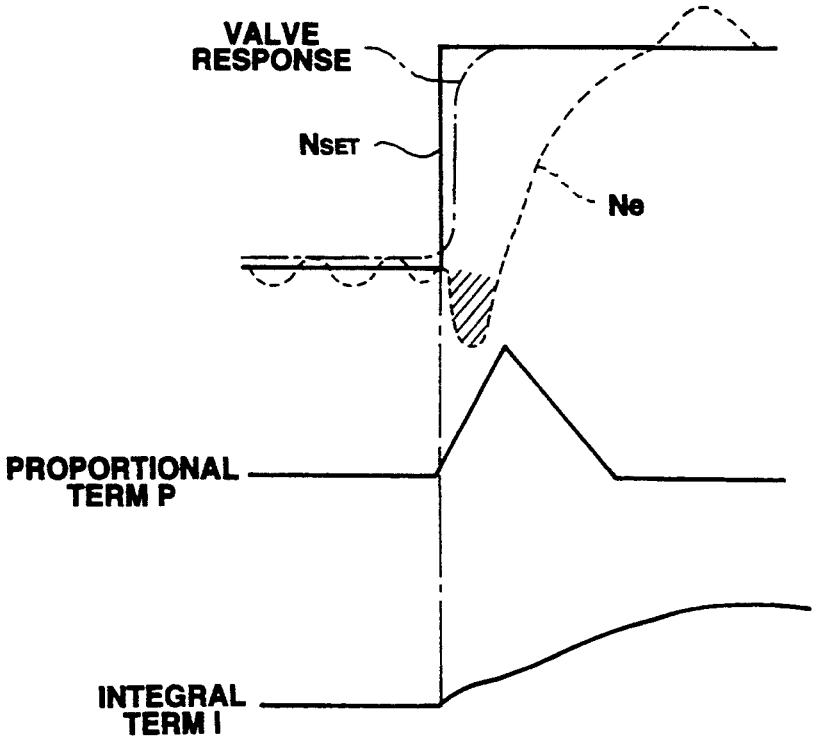
FIGS. 4 and 5 are graphs used in explaining the advantages of the invention over the prior art.
Figure 5:
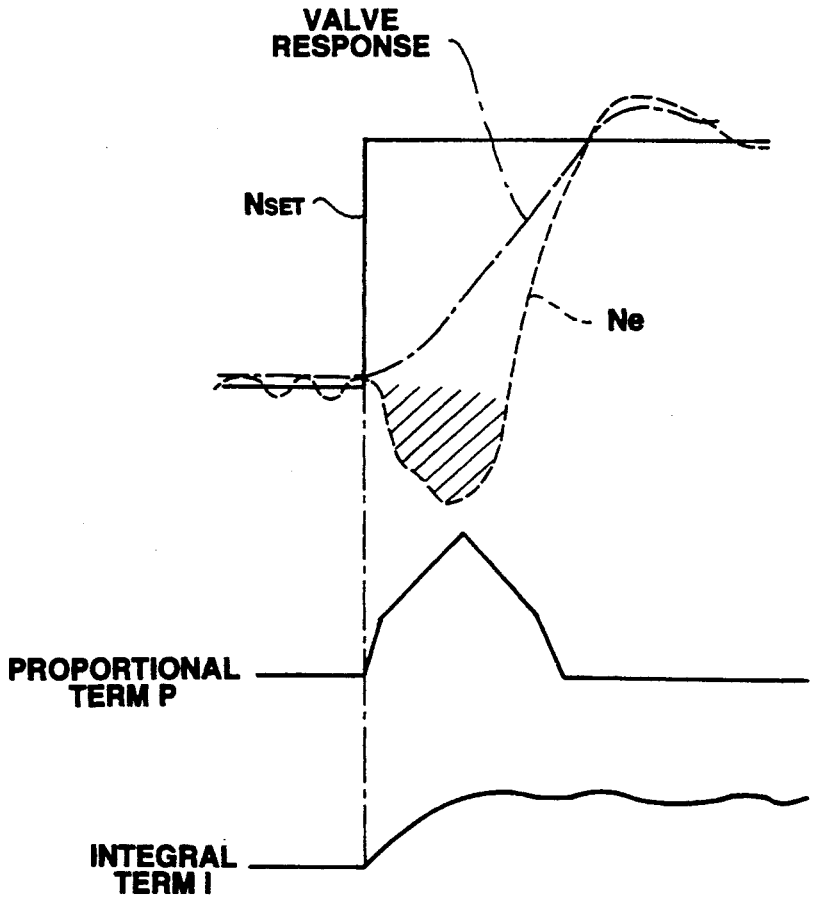

According to the invention, the control unit calculates a model engine speed $N_{model}$ to be followed by the engine speed in response to a change in the target engine idling speed $N_{SET}$. The auxiliary air amount $Q_a$ is controlled to achieve the model output torque $T_{model}$ which is an engine output torque corresponding to a change in the model engine speed $N_{model}$. It is, therefore, possible to control the engine speed in a manner to follow the target engine idling speed value $N_{SET}$ at a maximum response rate without the danger of hunting. This is effective to avoid a great engine speed drop which may occur when an air conditioner or the other accessory starts to operate, as shown in FIGS. 4 and 5. FIG. 4 shows an engine speed drop produced for an auxiliary air control valve 20 of the fast response type employing a linear solenoid. FIG. 5 shows an engine speed drop produced for an auxiliary control valve 20 of the slow response type employing a step motor.

Furthermore, a difference of the actual engine speed $N_e$ from the model engine speed $N_{model}$ is checked. When a difference occurs between the actual engine speed $N_e$ and the model engine speed $N_{model}$ due to engine variations and changes with time, the model correction torque $T_{intg}$ is set to correct the model output torque $T_{model}$ in a direction eliminating the difference. It is, therefore, possible to eliminate the influence of engine variations and changes with time on the engine idling speed control.

What is claimed is:

1. An apparatus for controlling the idling speed of an internal combustion engine including a throttle valve provided in an induction passage for controlling the amount of air flow through the induction passage, and an auxiliary air control valve provided in an auxiliary air passage bypassing the throttle valve for controlling the amount of air flow through the auxiliary air passage, the apparatus comprising:

sensor means sensitive to engine speed for producing an electrical signal indicative of a sensed engine speed;

means for calculating a target value for engine idling speed as a function of engine temperature;

means for calculating a model engine speed based upon the calculated target engine idling speed value;

means for calculating a model engine output torque based upon the calculated model engine speed, the model engine output torque being required to cause the sensed engine speed to follow the calculated model engine speed;

means for calculating a model correction torque based upon a difference of the sensed engine speed from the calculated model engine speed, the model correction torque being required to correct an error in the model engine output torque;

means for correcting the model engine output torque based upon the calculated model correction torque;

means for calculating an amount of air flow through the auxiliary air passage based upon the corrected model engine output torque and the calculated model engine speed; and means for controlling the auxiliary air control valve to permit the calculated amount of air to flow through the auxiliary air passage.

2. The engine idling speed control apparatus as claimed in claim 1, wherein the model engine speed calculating means includes means for repetitively calculating the model engine speed $N_{model}$ at uniform intervals as $N_{model}=N_{model-1}\cdot r+(100-r)\cdot N_{SET}$ where $N_{model-1}$ is the last value of the model engine speed, r is a weight, and $N_{SET}$ is the calculated target engine idling speed value.

* * * * *